US005538159A

United States Patent [19]

Snyder et al.

[11] Patent Number: 5,538,159

[45] Date of Patent: Jul. 23, 1996

[54] PORTABLE WOOD DISPENSER

[76] Inventors: Ted G. Snyder, Box 567, Invermere, British Columbia, Canada, V0A 1K0; James Glazier, Box 2018, Golden British Columbia, Canada, V0A-1H0; Gerry Huggins, Box 328, Pemberton, British Columbia, Canada, V0N-2L0

[21] Appl. No.: 334,966

[22] Filed: Nov. 7, 1994

[51] Int. Cl.[6] ..... B65G 59/00

[52] U.S. Cl. ..... 221/131; 312/326

[58] Field of Search ..... 221/92, 130, 131, 221/194; 312/45, 117, 215, 351.3, 348.3, 326; 211/86, 107

[56] References Cited

U.S. PATENT DOCUMENTS

| | | | |
|---|---|---|---|
| 606,556 | 6/1898 | Keith | 312/215 |
| 1,734,889 | 11/1929 | Amsden | 312/351.3 |
| 3,032,382 | 5/1962 | Jordan | 312/351.3 |
| 4,826,265 | 5/1989 | Hockenberry | 312/326 |

*Primary Examiner*—Kenneth Noland

[57] ABSTRACT

A portable wood dispenser comprising a housing having parallel side walls, a back wall, a floor and a roof with legs depending from the floor for the support thereof; a plurality of horizontal divider members and a plurality of vertical divider members within the housing with the horizontal divider members parallel with the floor and the vertical divider members parallel with the side walls to thereby define a plurality of compartments in rows and columns adapted for the receipt of firewood; a plurality of doors, each door adapted to be pivotally secured with respect to an associated compartment, each door adapted to be opened to allow the placement of firewood within the compartment and for the dispensing of the firewood therefrom; a lock secured to each door with an associated locking plate secured to the vertical extent of each compartment remote from the hinge, the lock adapted to secure the door in the closed orientation; and a key positionable within each lock and adapted to unlock a door to allow its opening for the placement of firewood therein and the dispensing of firewood therefrom.

2 Claims, 3 Drawing Sheets

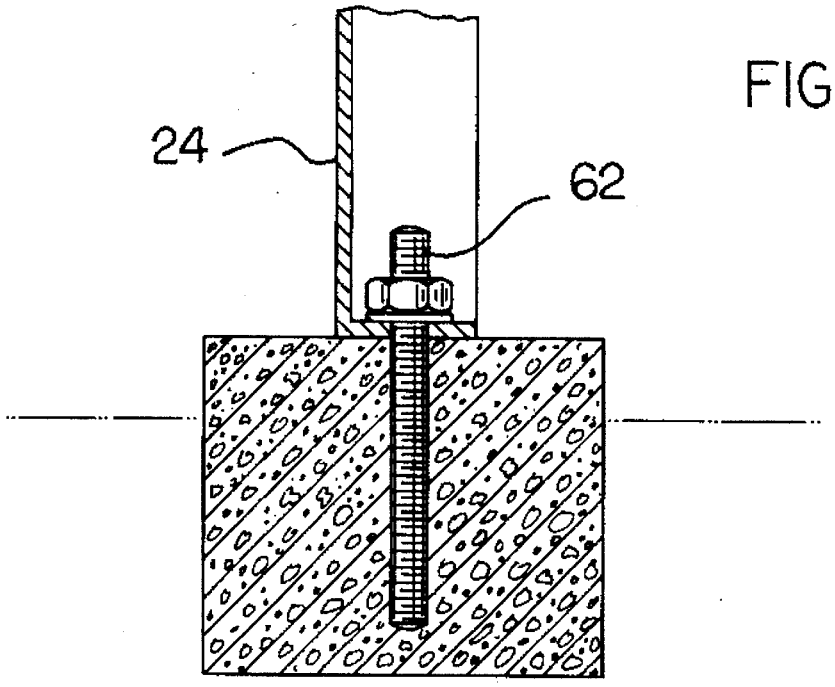
FIG. 5
FIG. 6
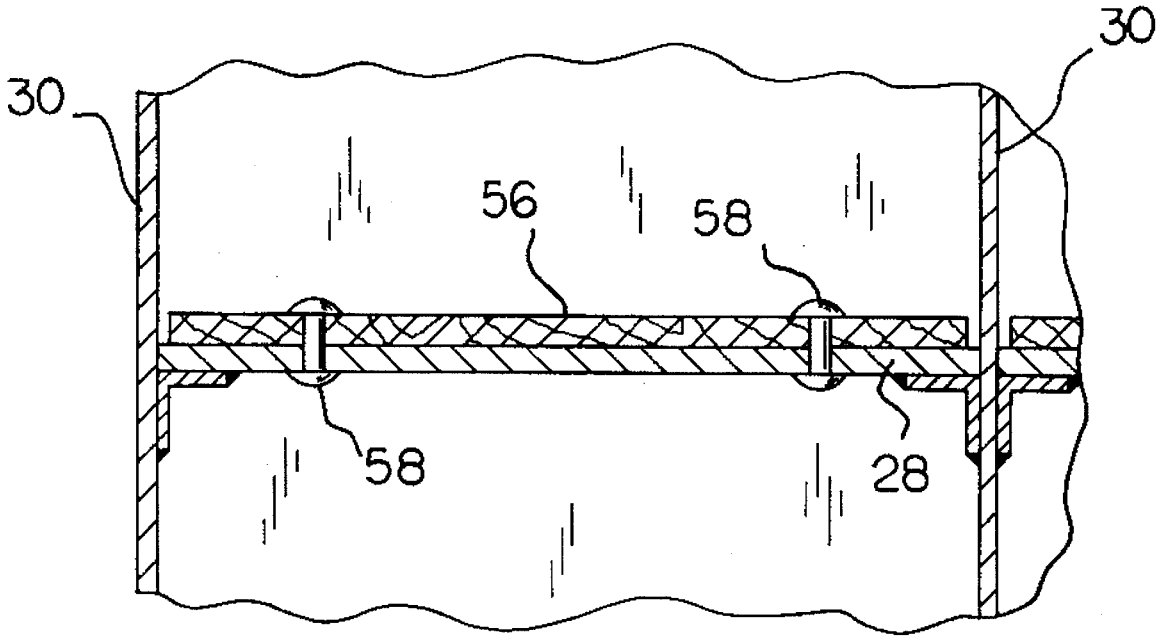

FIG. 3
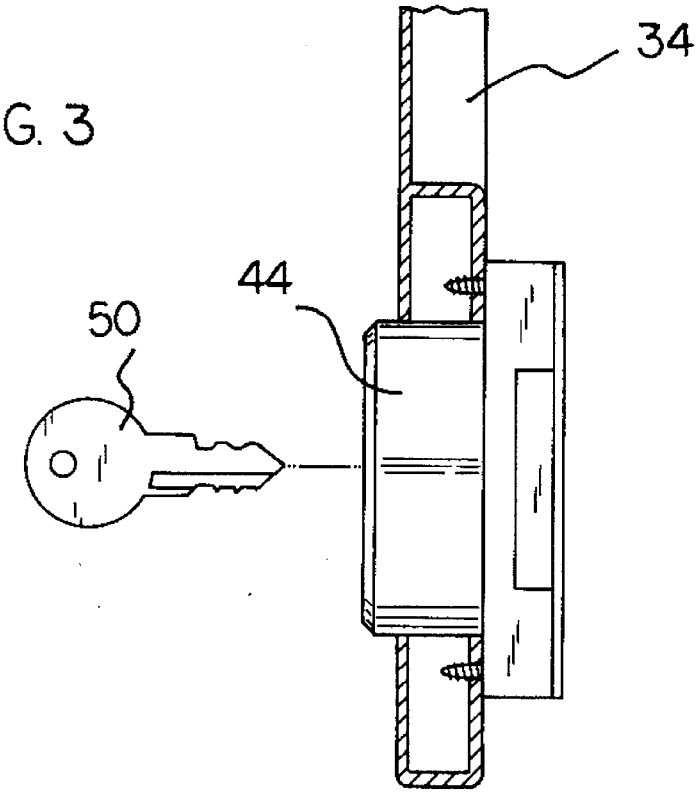
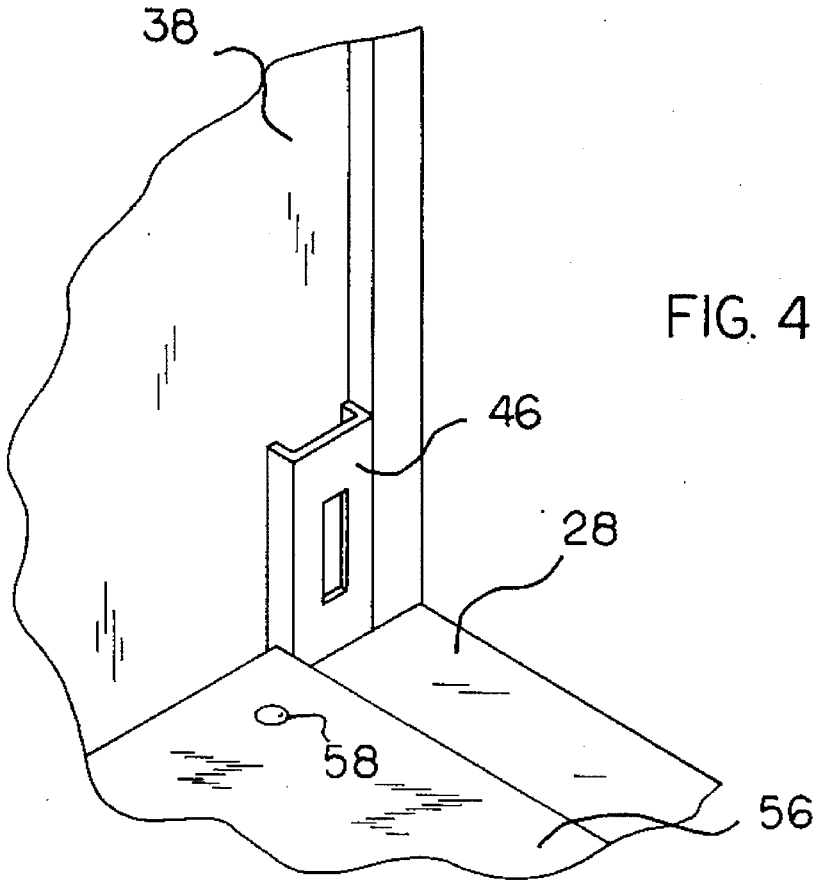
FIG. 4

PORTABLE WOOD DISPENSER

BACKGROUND OF THE INVENTION

1. Field of the Invention

The present invention relates to a PORTABLE WOOD DISPENSER and more particularly pertains to dispensing firewood from a container through the use of a purchased key.

1. Description of the Prior Art

The use of apparatus for dispensing products is known in the prior art. More specifically, apparatus for dispensing products heretofore devised and utilized for the purpose of dispensing products from containers through the use of coins, tokens, slugs, keys and the like are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,146,122 to Harris a dispensing device having a coin operated door lock.

U.S. Pat. No. 4,446,957 to Dohse discloses a coin operated article dispensing mechanism.

U.S. Pat. No. 4,540,107 to Davidson discloses a firewood storing and dispensing apparatus.

U.S. Pat. No. 4,957,196 to Shiojima discloses a coin-operated locker.

Lastly, U.S. Pat. No. 5,050,738 to McAdams discloses a firewood package.

In this respect, the PORTABLE WOOD DISPENSER according to the present invention substantially departs from the conventional concepts and designs of the prior art, and in so doing provides an apparatus primarily developed for the purpose of dispensing firewood from a container through the use of a purchased key.

Therefore, it can be appreciated that there exists a continuing need for a new and improved PORTABLE WOOD DISPENSER which can be used for dispensing firewood from a container through the use of a purchased key. In this regard, the present invention substantially fulfills this need.

SUMMARY OF THE INVENTION

In view of the foregoing disadvantages inherent in the known types of apparatus for dispensing products now present in the prior art, the present invention provides an improved PORTABLE WOOD DISPENSER. As such, the general purpose of the present invention, which will be described subsequently in greater detail, is to provide a new and improved PORTABLE WOOD DISPENSER apparatus and method which has all the advantages of the prior art and none of the disadvantages.

To attain this, the present invention essentially comprises a new and improved portable wood dispenser comprising, in combination, a housing having parallel side walls, a back wall, a floor and a roof with legs depending from the floor for the support thereof; a plurality of horizontal divider members and a plurality of vertical divider members within the housing with the horizontal divider members parallel with the floor and the vertical divider members parallel with the side walls to thereby define a plurality of compartments in rows and columns adapted for the receipt of firewood; a plurality of doors, each door adapted to be pivotally secured with respect to an associated compartment; a hinge with a spring coupling the side of each door with an associated vertical extent of an associated compartment, each spring tending to urge its associated door to a closed position, each door adapted to be opened to allow the placement of firewood within the compartment and for the dispensing of the firewood therefrom; a snag lock secured to each door with an associated locking plate secured to the vertical extent of each compartment remote from the hinge, the lock adapted to secure the door in the closed orientation; a key positionable within each lock and adapted to unlock a door to allow its opening for the placement of firewood therein and the dispensing of firewood therefrom, each key adapted to be retained within the lock after the dispensing of wood until the key is removed by an operator through a snag lock key remover subsequent to the placement of additional firewood within the compartment; a wood panel positionable on the lower surface of each compartment with rivets to secure such panel in position on the lower surface of each compartment to abate damage to the compartment; and bolt means adapted to secure the legs of the device to the ground in a predetermined orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved PORTABLE WOOD DISPENSER which has all the advantages of the prior art apparatus for dispensing productss and none of the disadvantages.

It is another object of the present invention to provide a new and improved PORTABLE WOOD DISPENSER which may be easily and efficiently manufactured and marketed.

It is a further object of the present invention to provide a new and improved PORTABLE WOOD DISPENSER which is of a durable and reliable construction.

An even further object of the present invention is to provide a new and improved PORTABLE WOOD DISPENSER which is susceptible of a low cost of manufacture with regard to both materials and labor, and which accordingly is then susceptible of low prices of sale to the consuming public, thereby making such apparatus for dispensing productss economically available to the buying public.

Still yet another object of the present invention is to provide a new and improved PORTABLE WOOD DISPENSER which provides in the apparatuses and methods of the prior art some of the advantages thereof, while simultaneously overcoming some of the disadvantages normally associated therewith.

Still another object of the present invention is to dispense firewood from a container through the use of a purchased key.

Lastly, it is an object of the present invention to provide a new and improved portable wood dispenser comprising a housing having parallel side walls, a back wall, a floor and a roof with legs depending from the floor for the support thereof; a plurality of horizontal divider members and a plurality of vertical divider members within the housing with the horizontal divider members parallel with the floor and the vertical divider members parallel with the side walls to thereby define a plurality of compartments in rows and columns adapted for the receipt of firewood; a plurality of doors, each door adapted to be pivotally secured with respect to an associated compartment, each door adapted to be opened to allow the placement of firewood within the compartment and for the dispensing of the firewood therefrom; a lock secured to each door with an associated locking plate secured to the vertical extent of each compartment remote from the hinge, the lock adapted to secure the door in the closed orientation; and a key positionable within each lock and adapted to unlock a door to allow its opening for the placement of firewood therein and the dispensing of firewood therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description remakes reference to the annexed drawings wherein:

FIG. 3 is a cross-sectional view of the lock of the device shown in the prior Figures taken along line 3—3 of FIG. 2, FIG. 4 is an enlarged perspective view of a portion of one of the compartments taken from interior of the compartment.

FIG. 5 is a cross-sectional view showing a possible mounting of the device into the ground for permanent installation.

FIG. 6 is a cross-sectional view of the bottom portion of one of the compartments.

DESCRIPTION OF THE PREFERRED EMBODIMENT

Figure 1:
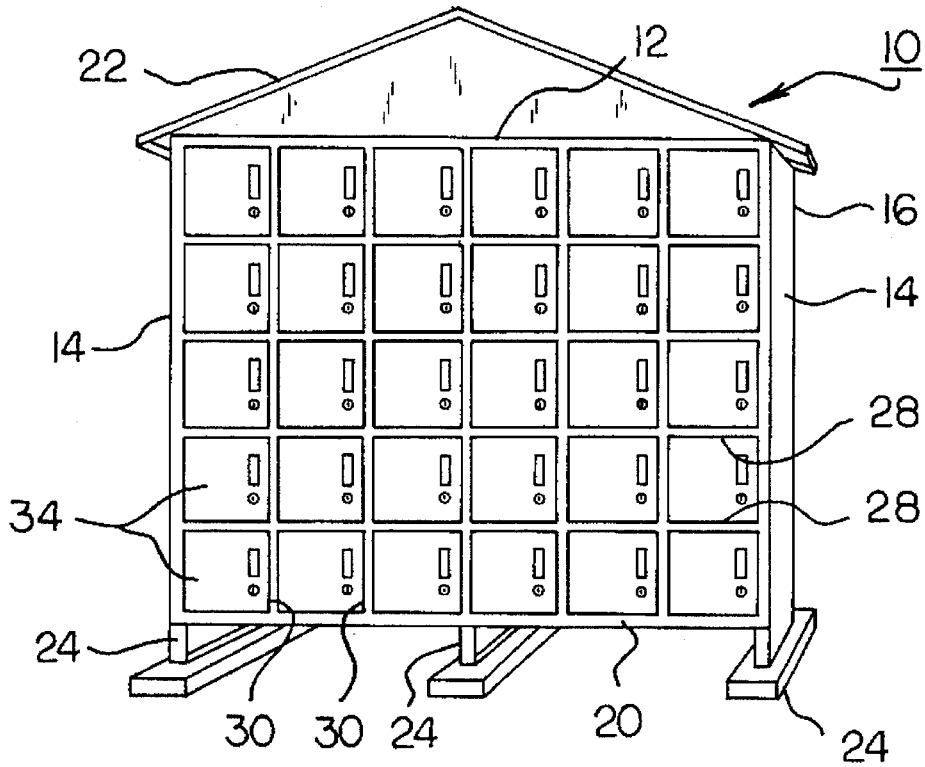
FIG. 1 is a perspective illustration of the preferred embodiment of the new and improved PORTABLE WOOD DISPENSER constructed in accordance with the principles of the present invention.
Figure 2:
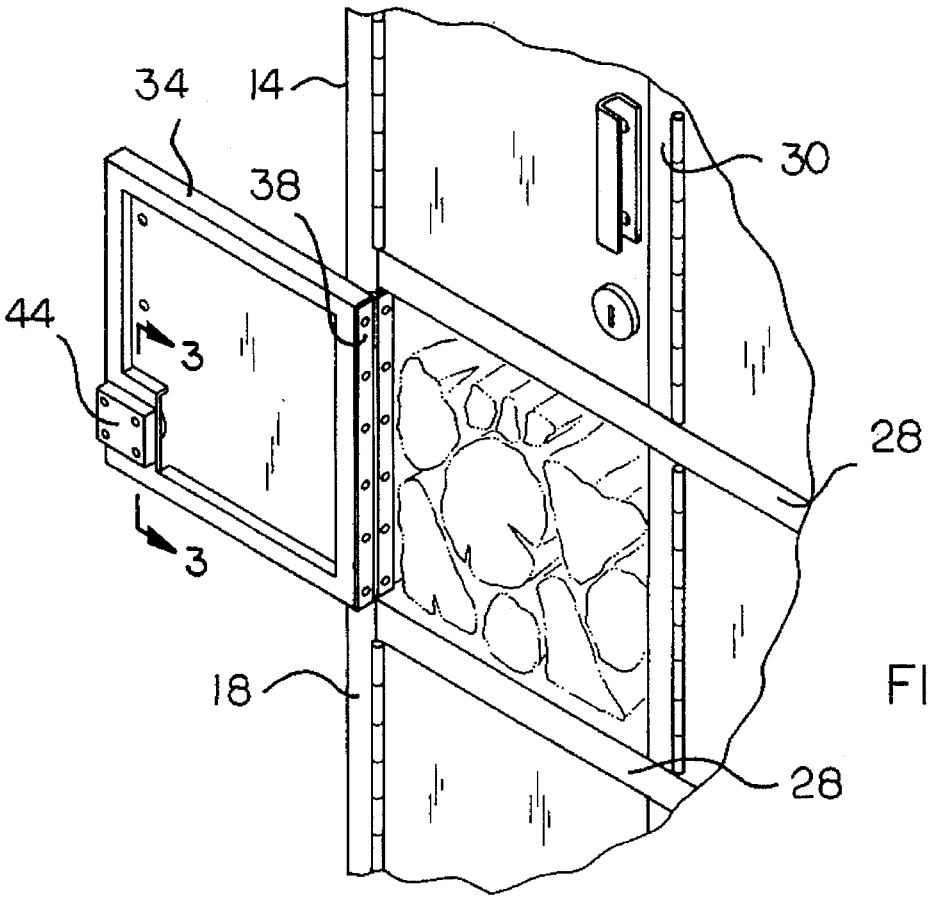
FIG. 2 is an enlarged perspective view of one of the compartments of the device shown in FIG. 1 but with one door open.

With reference now to the drawings, and in particular to FIG. 1 thereof, a new and improved PORTABLE WOOD DISPENSER embodying the principles and concepts of the present invention and generally designated by the reference numeral 10 will be described.

The present invention, the new and improved PORTABLE WOOD DISPENSER is comprised of a plurality of components. In their broadest context, such components include a housing, dividers, doors, hinges, locks, keys, wood panels and bolts. Such components are specifically configured and corelated with respect to each other so as to attain their desired objective.

More specifically, the housing 12 is a generally rectangular structure. It has parallel side walls 14, a back wall 16, an open front 18, a floor 20 and a roof 22. It also has legs 24 depending from the floor at the ends and centrally thereof for elevated support.

Within the housing 12 are a plurality of horizontal divider members 28 and a plurality of vertical divider members 30. Such dividers are within the sidewalls, backwall, floor and roof of the housing. The horizontal divider members are parallel with the floor while the vertical divider members are parallel with the sidewalls. The divider members thus define a plurality of compartments in rows and columns adapted for the receipt of firewood.

Associated with each individual compartment is a door 34. Each door is adapted to be pivotally secured along one vertical edge with respect to an associated compartment. The door is thus adapted to open and close the compartment for providing or excluding access with respect thereto.

Associated with each door and its associated compartment is a hinge 38. The hinge is provided with a spring 40 coupling the side of each door with an associated vertical extent of an associated compartment. Each spring tends to urge its associated door to a closed position. Each door is also adapted to be opened for either allowing the placement of firewood within the compartment or for dispensing of the firewood therefrom.

Within each door is a snag lock 44. Each such snag lock is secured to its associated door with an associated locking plate 46. The associated locking plate is secured to the vertical extent of each compartment remote from its associated hinge. The lock is thus adapted to secure the door in the closed orientation when locked. When unlocked, the door may be opened.

In association with each snag lock is a snag lock key 50. Such key is positionable within each lock. Each key is adapted to lock or unlock a door for allowing locking as sell as opening for both the placement of firewood therein and for the dispensing of firewood therefrom by someone with a key. Each key is adapted to be retained within the lock after the dispensing of wood. The key may subsequently be removed by an operator through a snag lock key remover 52. This is done subsequent to the placement of addtional firewood within the compartment.

Further features of the invention include a wood panel 56 positioned on the lower surface of each compartment.

Securement is by rivets 58. Such rivets secure such panel in position on the lower surface of each compartment. The wood panel tends to abate damage to the compartment through extended use.

Although the present invention is intended to be a portable housing for its intended function, in some instances it may be desired to render the housing permanently located or essentially permanently located. Such permanent locating is done through the use of bolts 62. Such bolts are adapted to secure the legs of the housing to the ground preferably by securement in a foundation as in concrete. Such positioning is in a predetermined location or orientation as desire by an operator.

The present invention is a type of vending machine that dispenses wood bundles upon deposit of tokens or slugs. In addition to protecting the wood bundles from theft (a common problem where "open" bundles are placed), it keeps the wood dry and clean. Many parks, particularly those in Canada, purchase wood on a contract basis from independent sellers and place the wood in open distribution areas where it is subject to weather and theft.

The machine has a large front panel measuring roughly 5½ 'by 7'. The front panel features 30 separate doors each covering one bundle of wood measuring one square foot. The slots are 16" deep. Each door is also equipped with its own coin slot and a window for viewing the wood inside. The individual doors operate in the manner of those found on newspaper boxes. Beacuse they are entirely mechanical and require no electricity, the present invention can be installed anywhere. The entire front panel is hinged and can be opened by park personnel for refilling of wood. Because the unit is filled from the front, two units can be installed back-to-back, permitting the storage of 60 bundles of wood in very little space. A shed roof can even be built on top of two back-to-back units providing protection and advertising space. Unit could either be bought outright or leased as various other vending machines are.

As to the manner of usage and operation of the present invention, the sane should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A new and improved PORTABLE WOOD DISPENSER comprising, in combination:

a housing having parallel side walls, a back wall, a floor and a roof with legs depending from the floor for the support thereof;

a plurality of horizontal divider members and a plurality of vertical divider members within the housing with the horizontal divider members parallel with the floor and the vertical divider members parallel with the side walls to thereby define a plurality of compartments in rows and columns adapted for the receipt of firewood;

a plurality of doors, each door adapted to be pivotally secured with respect to an associated compartment;

a hinge with a spring coupling the side of each door with an associated vertical extent of an associated compartment, each spring tending to urge its associated door to a closed position, each door adapted to be opened to allow the placement of firewood within the compartment and for the dispensing of the firewood therefrom;

a snag lock secured to each door with an associated locking plate secured to the vertical extent of each compartment remote from the hinge, the lock adapted to secure the door in the closed orientation;

a key positionable within each lock and adapted to unlock a door to allow its opening for the placement of firewood therein and the dispensing of firewood therefrom, each key adapted to be retained within the lock after the dispensing of wood until the key is removed by an operator through a snag lock key remover subsequent to the placement of additional firewood within the compartment;

a wood panel positionable on the lower surface of each compartment with rivets to secure such panel in position on the lower surface of each compartment to abate damage to the compartment; and bolt means adapted to secure the legs of the device to the ground in a predetermined orientation.

2. A PORTABLE WOOD DISPENSER comprising:

a housing having parallel side walls, a back wall, a floor and a roof with legs depending from the floor for the support thereof;

a plurality of horizontal divider members and a plurality of vertical divider members within the housing with the horizontal divider members parallel with the floor and the vertical divider members parallel with the side walls to thereby define a plurality of compartments in rows and columns adapted for the receipt of firewood;

a plurality of doors, each door adapted to be pivotally secured with respect to an associated compartment, each door adapted to be opened to allow the placement of firewood within the compartment and for the dispensing of the firewood therefrom;

a lock secured to each door with an associated locking plate secured to the vertical extent of each compartment remote from the hinge, the lock adapted to secure the door in the closed orientation; and a key positionable within each lock and adapted to unlock a door to allow its opening for the placement of firewood therein and the dispensing of firewood therefrom;

a wood panel positionable on the lower surface of each compartment with rivets to secure such panel in position on the lower surface of each compartment to abate damage to the compartment.

* * * * *